US010858876B2

(12) United States Patent
Ensign et al.

(10) Patent No.: US 10,858,876 B2
(45) Date of Patent: Dec. 8, 2020

(54) LOCK BOXES AND METHODS FOR STORING LOCKS

(71) Applicants: Jon Neil Ensign, Hobart, IN (US); Raymond Arthur Vincel, Valparaiso, IN (US)

(72) Inventors: Jon Neil Ensign, Hobart, IN (US); Raymond Arthur Vincel, Valparaiso, IN (US)

( * ) Notice: Subject to any disclaimer, the term of this patent is extended or adjusted under 35 U.S.C. 154(b) by 0 days.

(21) Appl. No.: 16/016,722

(22) Filed: Jun. 25, 2018

(65) Prior Publication Data

US 2018/0371824 A1 Dec. 27, 2018

Related U.S. Application Data

(60) Provisional application No. 62/523,996, filed on Jun. 23, 2017.

(51) Int. Cl.

| | |
|---|---|
| ***E05G 1/026*** | (2006.01) |
| ***E05G 1/00*** | (2006.01) |
| ***E05B 19/00*** | (2006.01) |
| ***B65D 25/54*** | (2006.01) |
| ***B65D 25/10*** | (2006.01) |
| ***E05B 65/52*** | (2006.01) |

(Continued)

(52) U.S. Cl.

CPC ..... *E05G 1/026* (2013.01); *B65D 25/108* (2013.01); *B65D 25/54* (2013.01); *E05B 19/0005* (2013.01); *E05B 65/52* (2013.01); *E05B 67/383* (2013.01); *E05G 1/005* (2013.01); *E05G 1/04* (2013.01)

(58) Field of Classification Search

CPC ..... E05G 1/026; E05G 1/005; E05G 1/04; E05G 2700/02; A47F 3/005; A47F 3/00; B65D 25/54; B65D 25/108; E05B 67/383; E05B 65/52; E05B 19/0005

USPC ..... 70/54–56, 63, 158–162, 370, 371, 451, 70/456 R, 459, 460; 109/53, 68, 70, 73, 109/76; 312/114, 126, 138.1, 139.2; 220/377, 848, 810–812, 826, 831, 833, 220/834, 345.1–345.4

See application file for complete search history.

(56) References Cited

U.S. PATENT DOCUMENTS

| | | | | |
|---|---|---|---|---|
| 1,954,896 A * | 4/1934 | Shriver | ..... | B21D 51/00 220/674 |
| 2,420,125 A * | 5/1947 | Crist | ..... | A47G 29/10 248/551 |

(Continued)

*Primary Examiner* — Lloyd A Gall

(74) *Attorney, Agent, or Firm* — Hartman Global IP Law; Gary M. Hartman; Domenica N. S. Hartman

(57) ABSTRACT

Lock boxes and methods of removably storing locks that have key holes and are operable with keys are provided. The lock boxes include a container body having an exterior and an interior cavity defined by walls of the container body with a window for viewing the interior cavity from the exterior, and structure within the interior cavity configured for arranging locks removably placed within the interior cavity so that the locks are arranged in an array and so that the key holes of the locks or any keys inserted therein are simultaneously visible through the window and so that all of the locks within the interior cavity can be audited through the window to confirm that the keys thereof are within the locks without accessing the interior cavity of the container body. Keys removed from locks that have been removed from the interior cavity can be similarly audited.

20 Claims, 10 Drawing Sheets

(51) Int. Cl.
*E05B 67/38* (2006.01)
*E05G 1/04* (2006.01)

(56) References Cited

U.S. PATENT DOCUMENTS

| | | | | | |
|---|---|---|---|---|---|
| 2,886,396 | A * | 5/1959 | Anthony | A47G 29/10 | 312/308 |
| 5,191,974 | A * | 3/1993 | Saalman | A47G 29/10 | 206/1.5 |
| 5,884,799 | A * | 3/1999 | Korber | B60R 7/04 | 220/345.3 |
| 9,016,095 | B2 * | 4/2015 | Dudgeon | E05G 1/08 | 109/53 |
| 9,875,460 | B2 * | 1/2018 | Zhu | A47G 29/10 | |
| 10,102,698 | B2 * | 10/2018 | Zhu | E05B 65/0075 | |
| 10,207,847 | B2 * | 2/2019 | Hollis | B65D 43/165 | |
| 10,633,156 | B2 * | 4/2020 | Enger | E05B 67/383 | |
| 2005/0199628 | A1 * | 9/2005 | Van Handel | A47G 29/10 | 220/315 |
| 2006/0042331 | A1 * | 3/2006 | Benda | E05B 73/00 | 70/63 |
| 2006/0162403 | A1 * | 7/2006 | Handel | A45C 13/1084 | 70/63 |
| 2009/0288457 | A1 * | 11/2009 | Moldal | A61J 1/1437 | 70/158 |
| 2010/0147853 | A1 * | 6/2010 | Hackett | B65D 7/16 | 220/315 |
| 2012/0198895 | A1 * | 8/2012 | De Maria | A47G 29/10 | 70/63 |
| 2013/0099641 | A1 * | 4/2013 | Saucier | A47G 29/10 | 312/237 |
| 2017/0113856 | A1 * | 4/2017 | Hollis | E05F 1/16 | |
| 2018/0075682 | A1 * | 3/2018 | Brockman | E05B 19/0005 | |

* cited by examiner

LOCK BOXES AND METHODS FOR STORING LOCKS

CROSS REFERENCE TO RELATED APPLICATIONS

This application claims the benefit of U.S. Provisional Application No. 62/523,996 filed Jun. 23, 2017, the contents of which are incorporated herein by reference.

BACKGROUND OF THE INVENTION

The present invention generally relates to containers configured to secure items. The invention particularly relates to lock boxes configured to secure locks in industrial settings in a manner that promotes ease of inspection.

Many industries implement strict safety policies when servicing machines, especially in industry and research settings. For example, lock out or lock out-tag out are common safety procedures which are used to ensure that dangerous machines are properly shut off and not able to be started up again prior to the completion of maintenance or repair work. In general, these procedures require that hazardous energy sources or machines are isolated and rendered inoperative before work is started on the equipment in question. A lock is placed on the power source or machine in order to prevent its activation, thereby reducing the likelihood of accidental startup while it is in a hazardous state or while a worker is in direct contact with it.

The locks used for such procedures must be carefully accounted for in order to ensure worker safety. Often these locks and/or keys are stored in lock boxes when not in use. Such lock boxes may simply consist of a metal box with a lockable lid and an internal cavity in which the locks are loosely stored. Such containers may present various shortcomings when inspection and auditing of the locks are necessary. For example, once the lock box is secured (locked) by one or more individuals with the authority to do so, such individuals must all be present to open the lock box during any audit. This can become a frustrating and time-consuming procedure, delaying the completion of maintenance or other task being performed.

In view of the above, it can be appreciated that there are certain problems, shortcomings or disadvantages associated with prior art lock boxes, and that it would be desirable if an improved lock box were available that was capable of securing locks in a manner that promotes ease of inspection.

BRIEF DESCRIPTION OF THE INVENTION

The present invention provides lock boxes suitable for storing locks and/or keys in a secure and organized manner that promotes ease of visual inspection without the necessity of removing the locks and/or keys from the lock boxes.

According to one aspect of the invention, a lock box is provided for removably storing locks that have key holes and are operable with keys. The lock box includes a container body having an exterior and an interior cavity defined by walls of the container body with at least a first of the walls having a window for viewing the interior cavity from the exterior of the container body, with the capability of protecting and concealing the window. The lock box further includes structure within the interior cavity that is configured for arranging locks removably placed within the interior cavity so that the locks are arranged in an array and the key holes of the locks or any keys inserted therein are visible through the window. The lock box also includes structure accessible from the exterior of the container body for securing the locks in the array within the interior cavity, and structure within the interior cavity for securing keys removed from one or more of the locks that have been removed from the interior cavity so that the removed keys are visible through the window.

According to another aspect of the invention, a method is provided of securing locks that have key holes and are operable with keys. The method includes providing a lock box comprising a container body having an exterior and an interior cavity defined by walls of the container body, wherein at least a first of the walls has a window for viewing the interior cavity from the exterior of the container body. The method entails removably placing locks within the interior cavity so that the locks are arranged in an array and the key holes of the locks or any keys inserted therein are visible through the window, securing the locks in the array within the interior cavity, and then locking the container body.

Technical effects of the lock box described above preferably include the ability to secure and organize locks within a lock box so that individuals can quickly inspect the contents of the lock box without opening the lock box.

Other aspects and advantages of this invention will be further appreciated from the following detailed description.

DETAILED DESCRIPTION OF THE INVENTION

Figure 1:
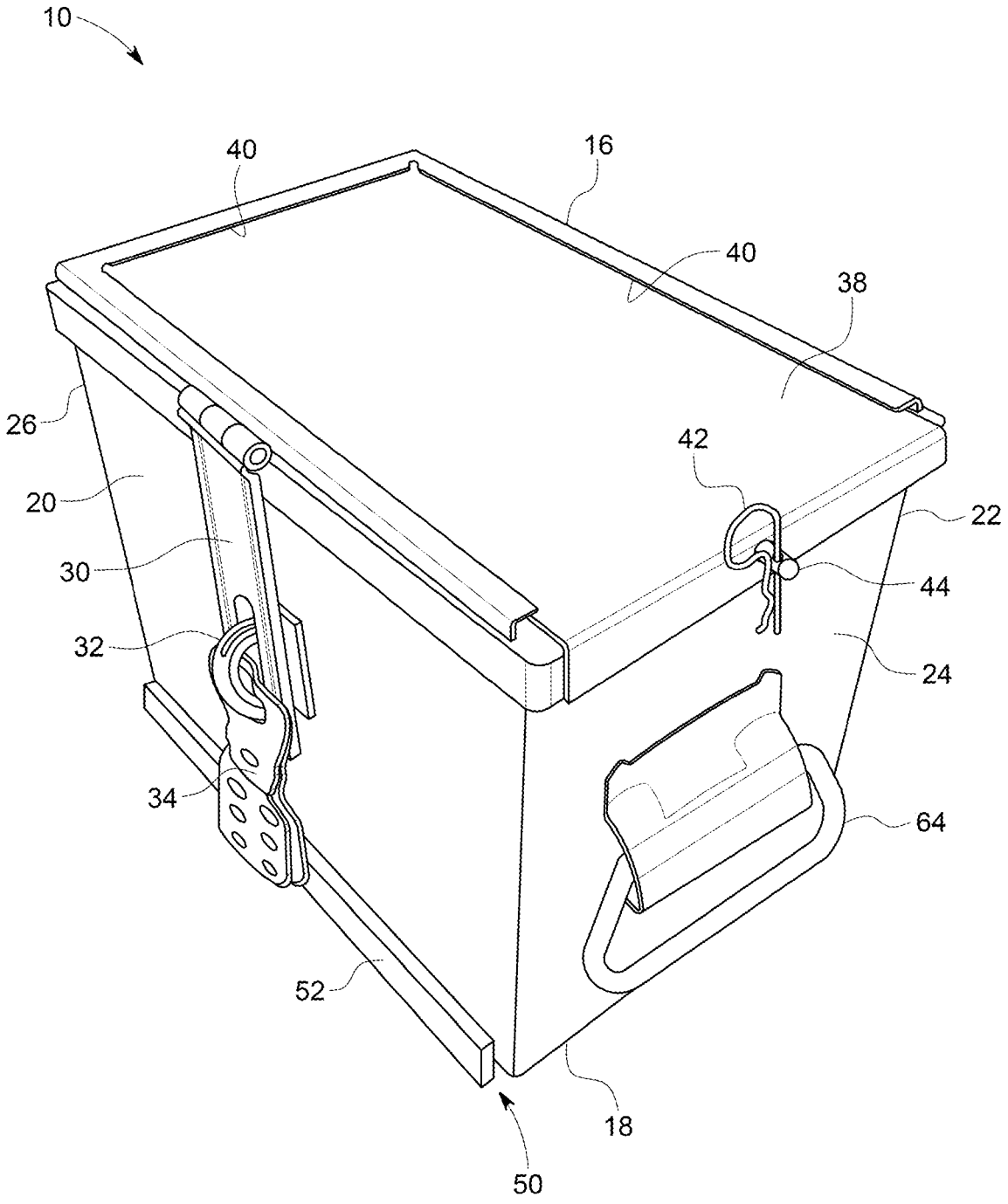
FIG. 1 schematically represents a perspective view of a lock box secured with an external lock in accordance with certain nonlimiting aspects of the invention.
Figure 2:
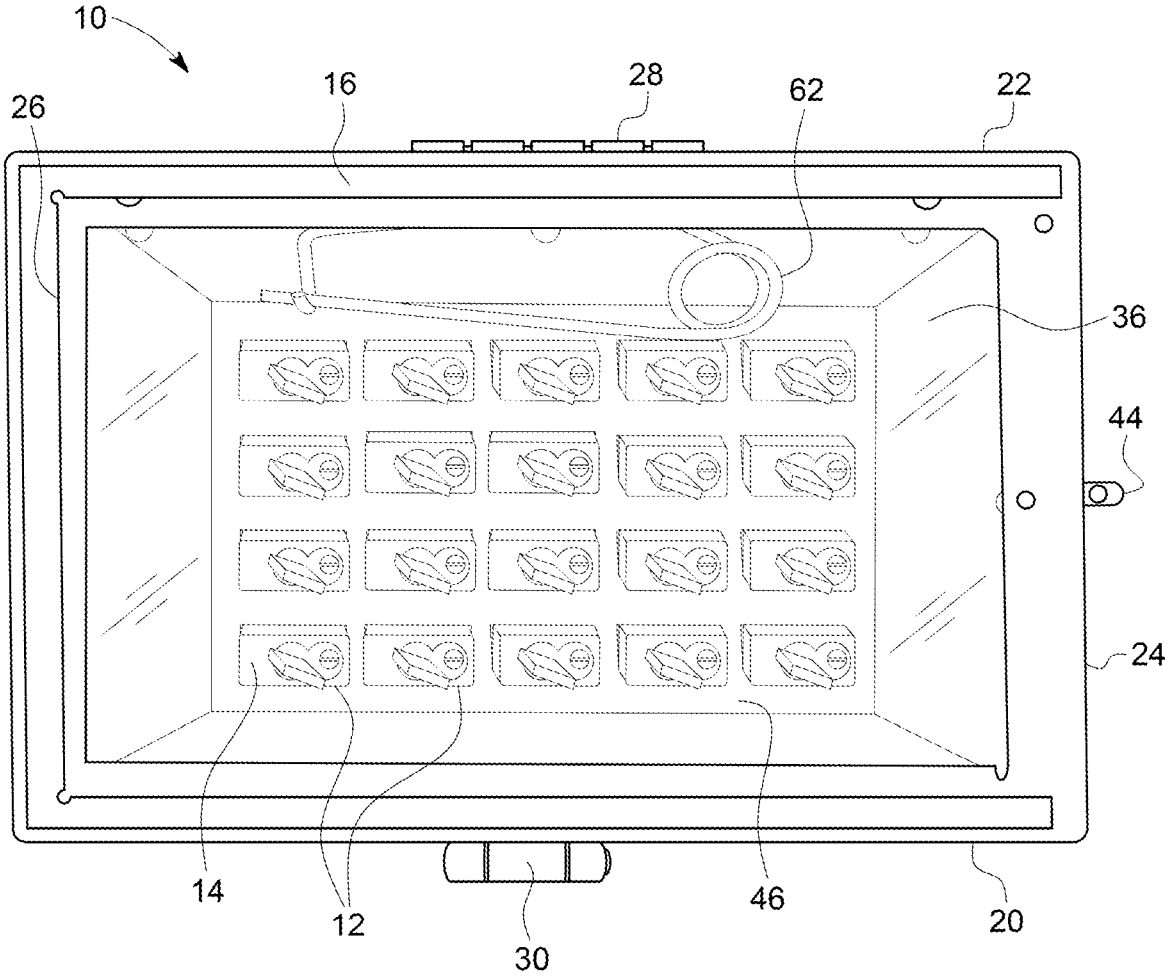
FIGS. 2 through 4 schematically represent top views of the lock box of FIG. 1 showing a window exposed, partially concealed with a cover, and entirely concealed with the cover, respectively.

FIGS. 1 through 10 represent various aspects of a lock box 10 in accordance with a nonlimiting embodiment of the invention. The lock box 10 is configured to provide a secure, mobile means of storing multiple locks 12 and/or corresponding keys 14 while allowing for quick and convenient auditing of the contents within the box 10. To facilitate the description provided below of the embodiment represented in the drawings, relative terms, including but not limited to, "top," "bottom," "horizontal," "lateral," "front," "rear," "side," "forward," "rearward," "upper," "lower," "above," "below," "right," "left," etc., may be used in reference to the orientation of the lock box 10 as represented in the drawings, and therefore are relative terms that indicate the construction, installation and use of the invention and therefore help to define the scope of the invention. Although the lock box 10 is discussed hereinafter in reference to locks 12 comprising a rectangular cuboid-shaped body and a U-shaped shackle, it is foreseeable that the lock box 10 could be configured to store and secure other types of locks.

Referring to FIG. 1, the lock box 10 includes a container body having an exterior and an interior cavity defined by an upper wall 16, a lower wall 18, a front wall 20, a rear wall 22, and side walls 24 and 26 of the container body. The upper wall 16 will hereinafter be referred to as the lid 16 of the box 10, as it is located at the top of the container body and is pivotally attached to the rear wall 22 with a hinge 28 to enable the lid (upper wall) 16 to be opened to provide access to the interior cavity of the box 10. It is within the scope of the invention that the lid 16 may be defined by a wall other than the upper wall and/or could be secured to the container body by means other than the hinge 28. The box 10 preferably includes means for locking the lid 16 in the closed position, for example, a latch 30 shown in FIG. 1 as being pivotally attached to the lid 16 and configured to receive a hasp 32 secured to the front wall 20 of the container body, and an exterior lock 34 or other fastener to secure the hasp 32 over the latch 30 to retain the lid 16 in a closed position.

Figure 3:
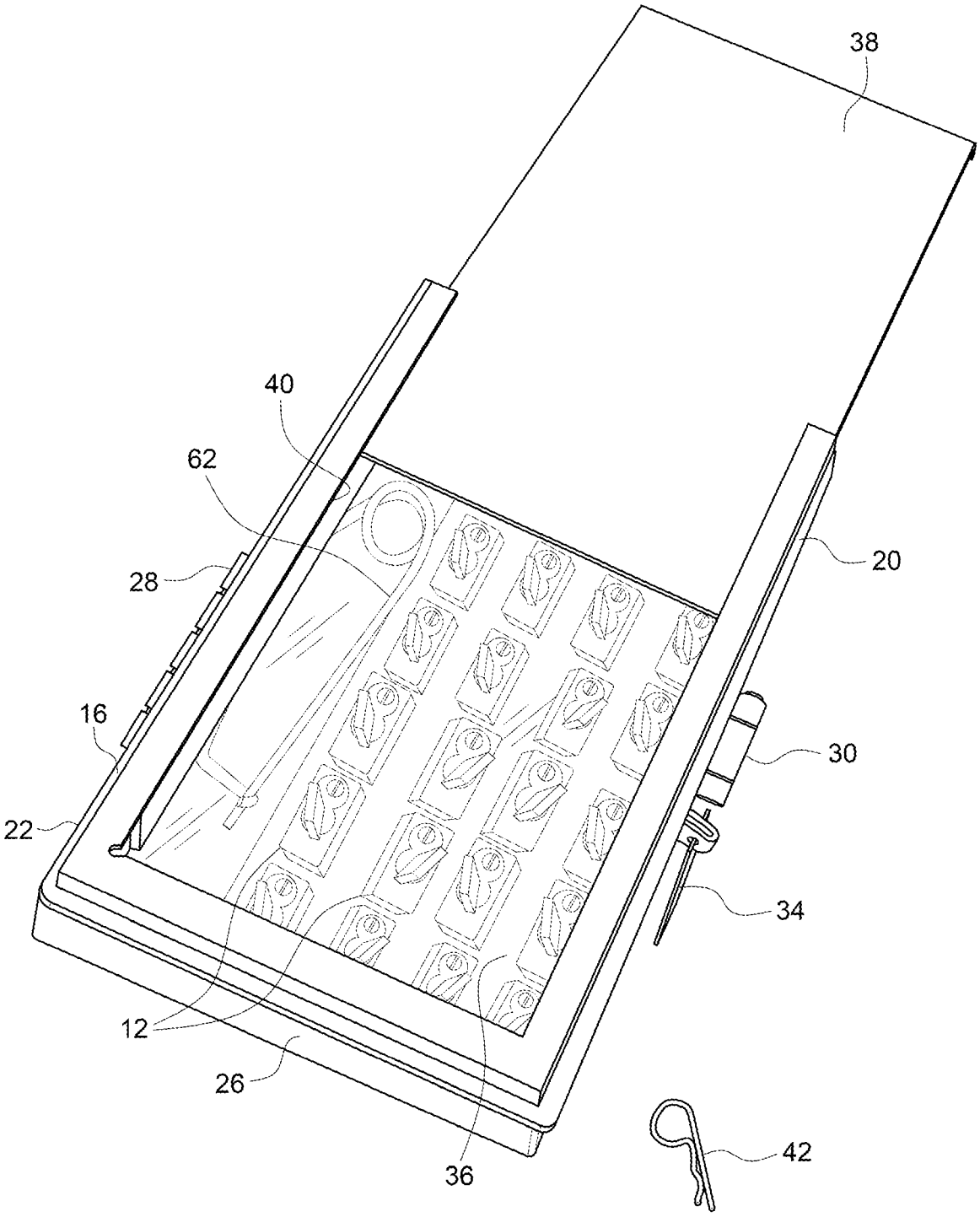
Figure 4:
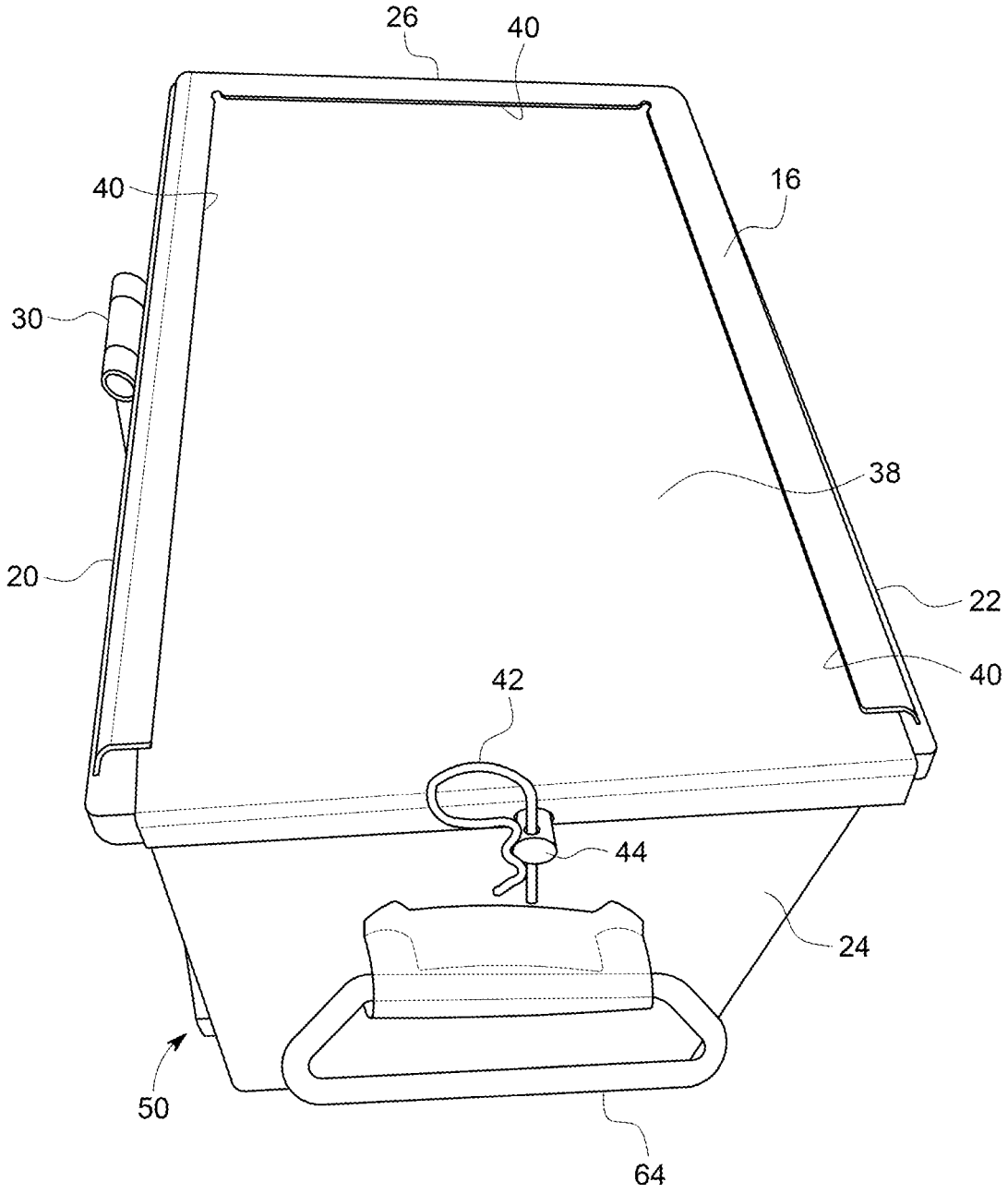

The lid 16 includes a window 36 for viewing the interior cavity from the exterior of the container body without opening the lid 16. Since the lock box 10 may be used in an industrial setting, it is preferred that a cover is provided to reduce the likelihood that the window 36 may become damaged, scratched, clouded, or otherwise altered in a manner that reduces the visibility or the security of the interior cavity. As seen in FIGS. 1, 3, and 4, the lock box 10 includes a protective cover 38 that is configured to be slidably received in an open end of a channel 40 along edges of the lid 16. Once the cover 38 is entirely slid into the channel 40 and fully covers the window 36, it may be secured in place with a fastener capable of preventing the cover 38 from exiting the open end of the channel 40. For example, the embodiment represented in the drawings includes a cotter pin 42 configured to be inserted into a corresponding horizontal ring 44, cylinder, hasp, or the like located on a side wall 24 adjacent the open end of the channel 40. Preferably, the fastener that secures the cover 38 is not lockable, which allows individuals to view the contents of the lock box 10 even if they do not have the authority or means to open the lock box 10. It is within the scope of the invention that the window 36 may be located on a wall other than the lid (upper wall) 16. Further, the cover 38 may be secured over the window 36 by various means. For example, the cover 38 could be pivotally attached relative to the window 36 and/or container body.

Figure 5:
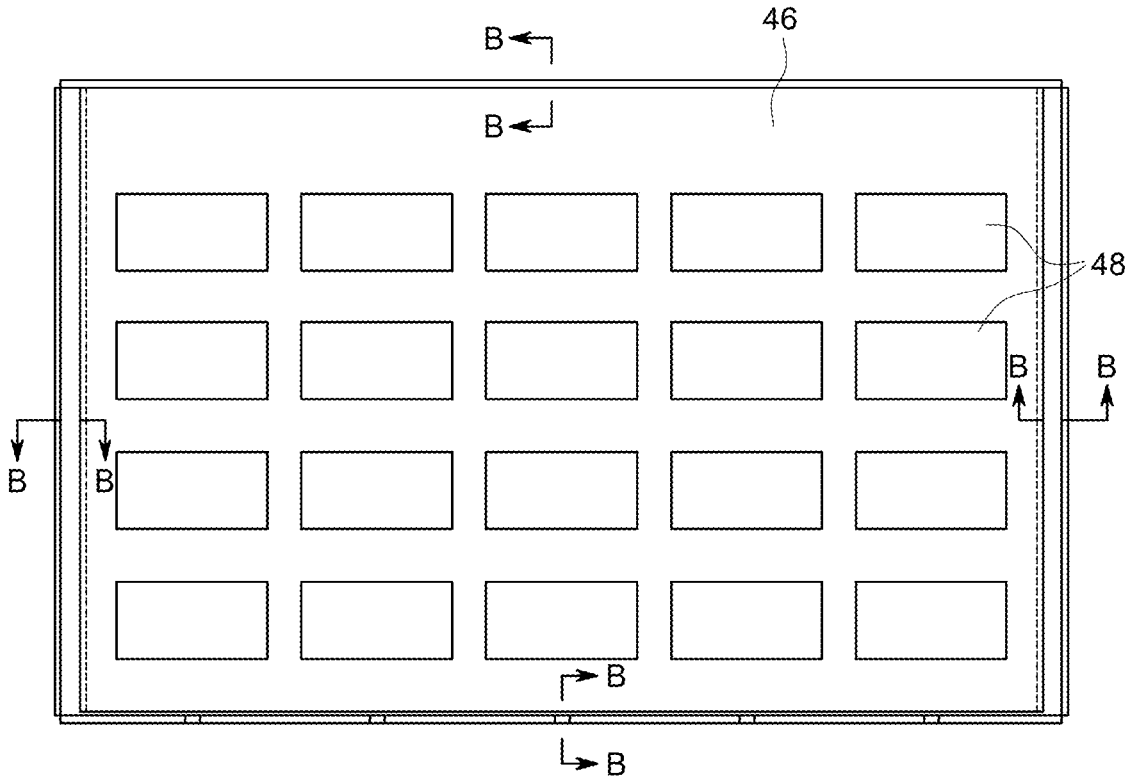
FIG. 5 schematically represents an isolated top view of a lock organization support plate located in the base of the lock box of FIG. 1. The support plate includes an array of recesses therein each configured to receive a corresponding lock.
Figure 6:
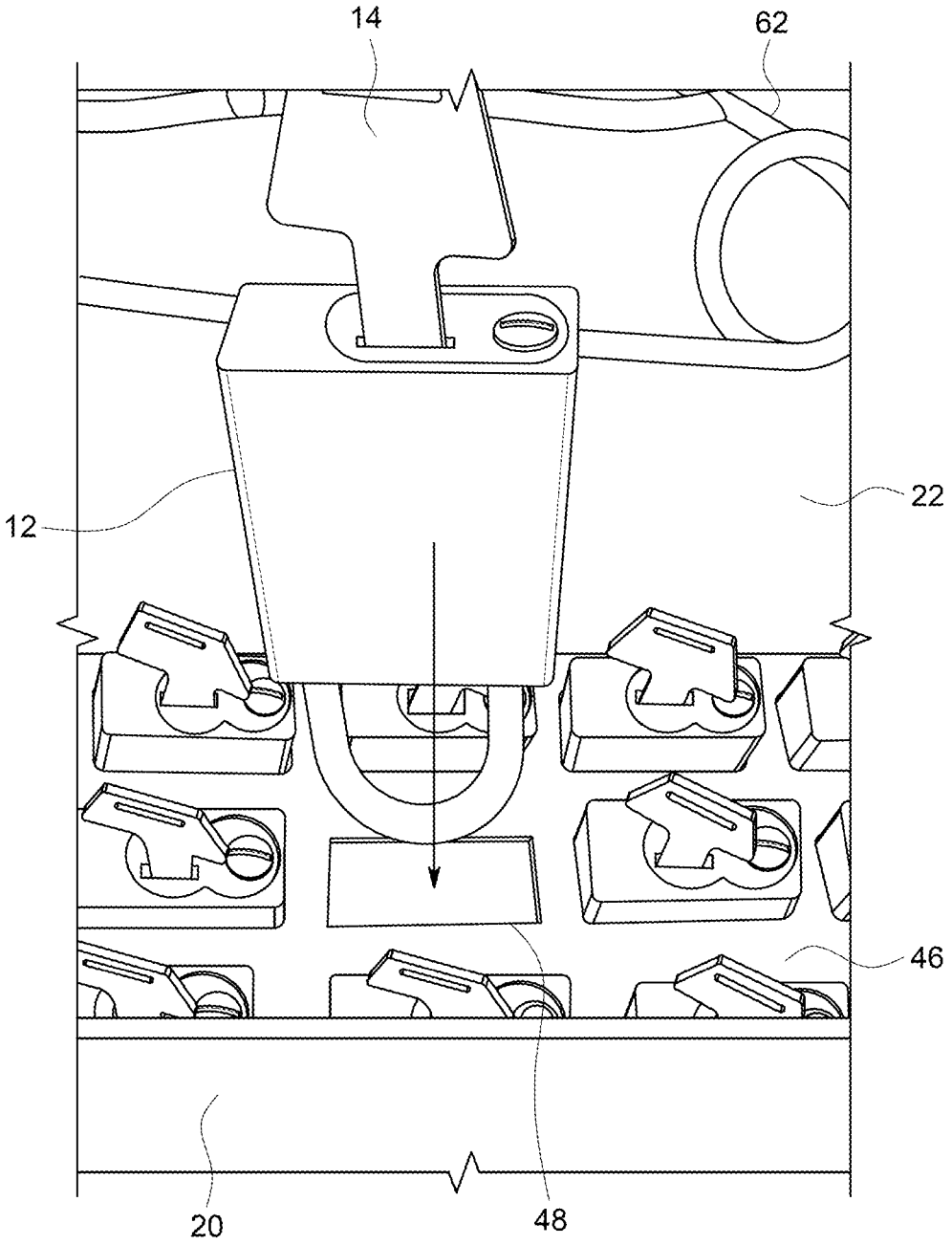
FIG. 6 schematically represents an enlarged view of an individual lock being inserted shackle first into a corresponding recess of the lock organization support plate of the lock box of FIG. 1.

The window 36 is intended to allow an individual to visually audit the contents of the interior cavity without opening the lid 16 or removing the contents therefrom. Loosely storing the locks 12 and/or the keys 14 within the interior cavity, as is typical with many conventional lock boxes, would likely make such audits impractical. Therefore, the lock box 10 preferably includes means within the interior cavity for arranging the locks 12 removably placed within the interior cavity so that the locks 12 are arranged in an array and the key holes of the locks 12 or any keys 14 inserted therein are visible through the window 36. For example, FIG. 5 is a top view representing a lock organization support plate 46 located and fixed in a base of the interior cavity. The support plate 46 includes an array of recesses 48 each configured to receive an individual lock 12, shackle first, and support the received lock 12 in a stationary position. FIG. 6 schematically represents a lock 12 as it is being inserted into one of the recesses 48 of the support plate 46, and FIGS. 2, 3, 6, and 7 represent multiple locks 12 individually supported within recesses 48 the support plate 46. For convenience, the array of the support plate 46 will be referred to herein as including rows and columns of recesses 48, wherein the rows extend between the side walls 24 and 26 of the lock box 10 and the columns extend between the front and rear walls 20 and 22 of the lock box 10. For example, FIG. 5 represents the support plate 46 as comprising four rows and five columns of recesses 48 capable of supporting up to twenty individual locks 12. It is foreseeable and within the scope of the invention that the lock box 10 may include any number of recesses 48 to receive more or fewer locks than the embodiment represented in the drawings. Further, the recesses 48 in the support plate 46 may be arranged in a pattern that is different from the array illustrated.

This orientation of the stored locks 12, that is, with the shackle directed away from the window 36, allows for the stored locks 12 to be observed, counted, and confirmed to have their corresponding key 14 within the lock 12 itself through the window 36 without opening the lid 16. Although not shown in the drawings, it is foreseeable that the locks 12, keys 14, support plate 46, or recesses 48 therein may have means of identifying which locks 12 are missing from the interior cavity. For example, the recesses 48 may display numbers corresponding to locks 12 and/or individuals responsible for the locks 12.

Figure 7:
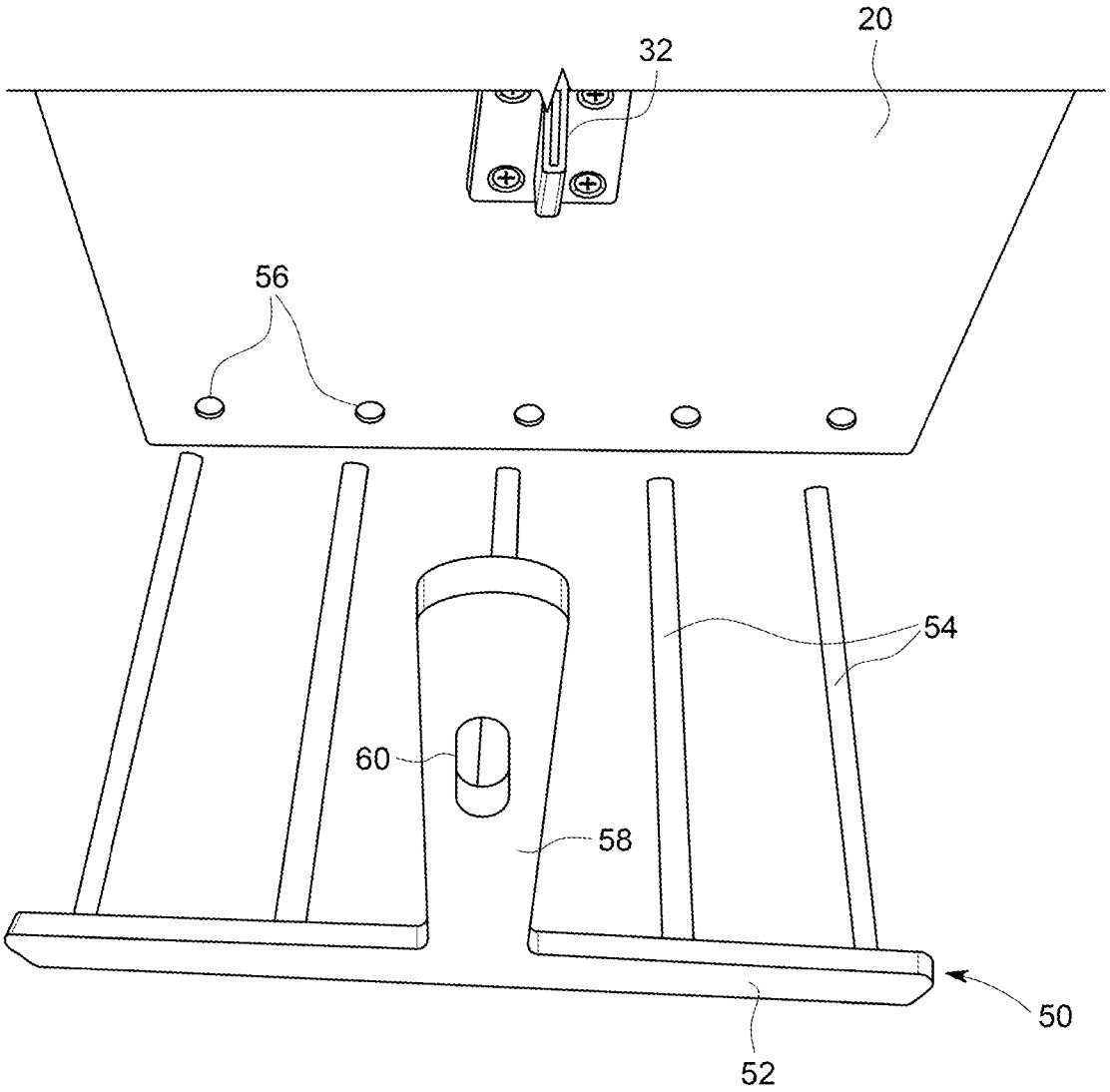
FIGS. 7 and 8 schematically represent a lock organization bracket removed from and partially inserted into, respectively, holes on a front wall of the lock box of FIG. 1.
Figure 8:
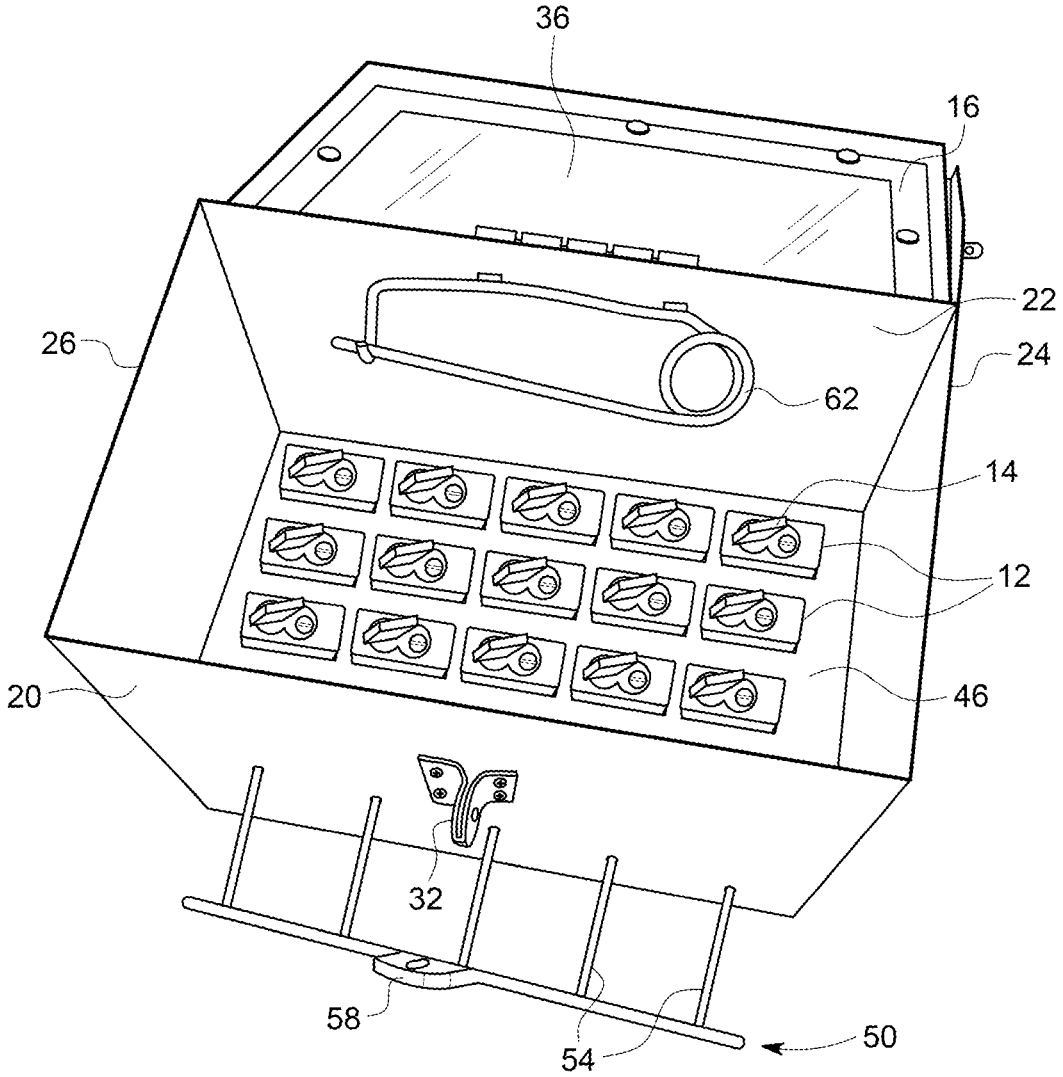
Figure 9:
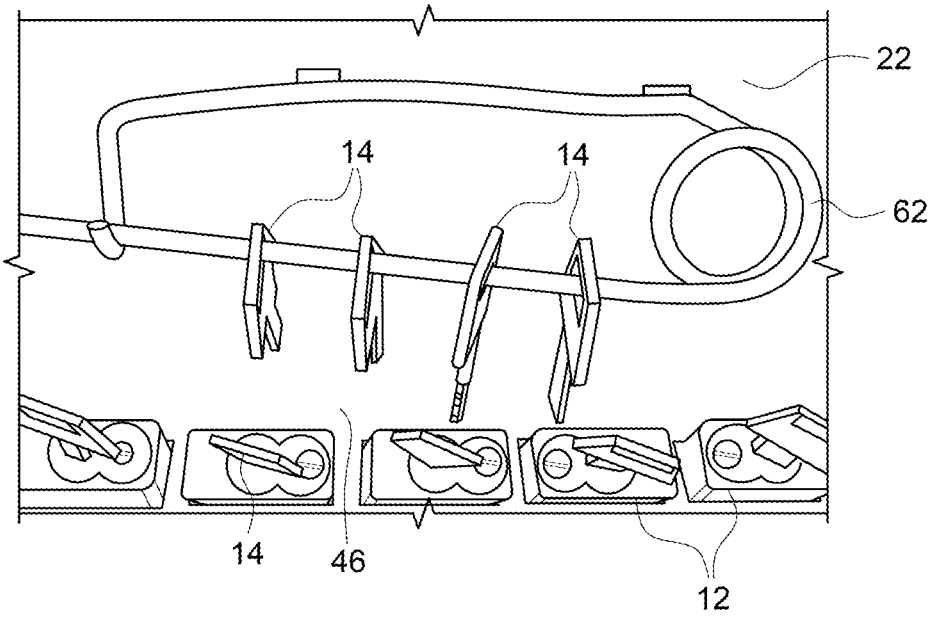
FIG. 9 schematically represents an enlarged view of a key holder of the lock box of FIG. 1.
Figure 10:
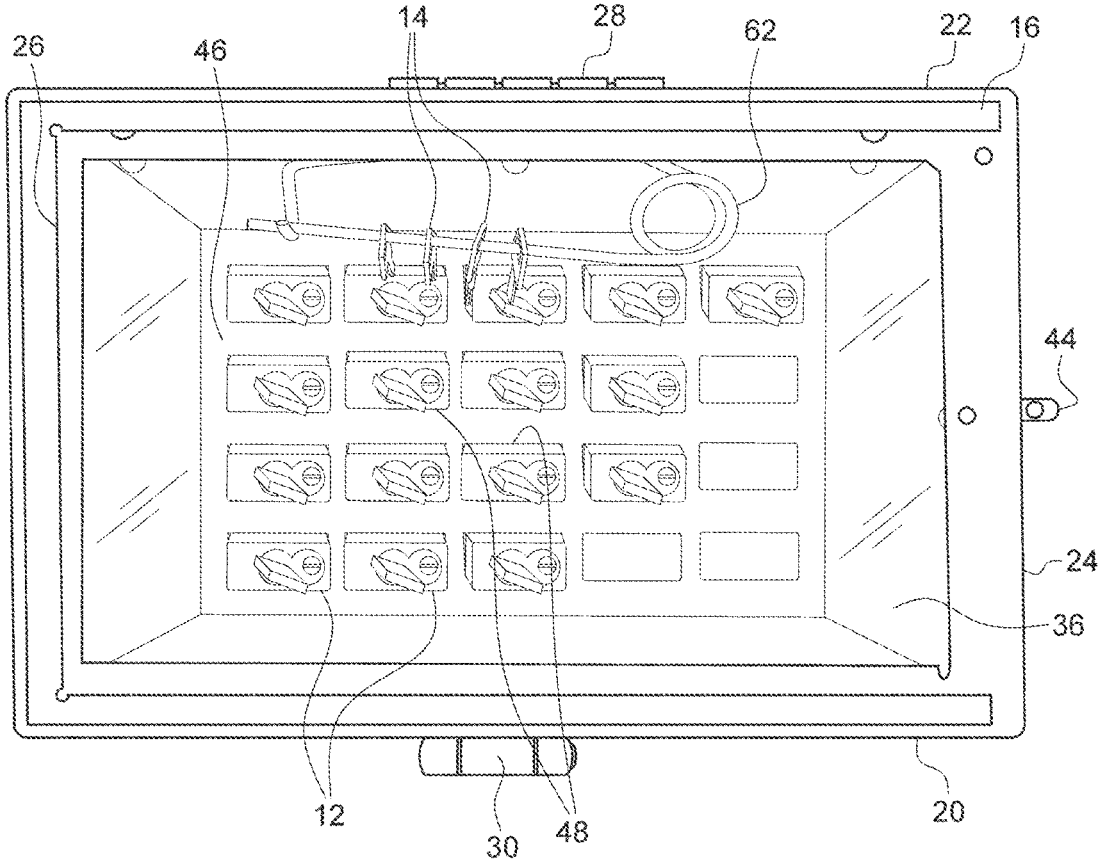
FIG. 10 schematically represents a top view of the lock box of FIG. 1 with unused locks and keys from used locks secured to the key holder, all viewable through the window.

A lock securement bracket 50 is provided that is configured to retain the locks 12 within their respective recesses 48 within the support plate 46. As represented in FIG. 7, the lock securement bracket 50 includes a crossbar 52 with elongated rods 54 extending therefrom that are configured to be slidably received within holes 56 located in the front wall 20 of the lock box 10, passing under the support plate 46, and inserted through the U-shaped shackles of each of the locks 12 supported by the support plate 46. Therefore, the lock securement bracket 50 includes a number of rods 54 equal to the amount of columns of recesses 48 in the support plate 46. Once fully inserted into the front wall 20 of the lock box 10, the rods 54 prevent the locks 12 from unintentionally exiting their respective recesses 48. A rigid latch 58 protruding vertically from the crossbar 52 includes a slot 60 that is configured to receive the hasp 32 on the front wall 20 of the lock box 10 when the rods 54 are fully inserted into the lock box 10. As represented in FIG. 1, the hasp 32 is preferably large enough to be received in both the slot 60 of the lock securement bracket 50 and the latch 30 of the lid 16 simultaneously such that both may be locked in place by securing a lock to the hasp 32.

The combination of the lock organization support plate 46 and lock securement bracket 50 provides a secure, organized orientation of the locks 12 ready for audit at any time through the window 36 without removing the locks 12 from the interior cavity. When the rods 54 are fully inserted into the lock box 10 and the lock securement bracket 50 is secured via the rigid latch 58 and hasp 32, the locks 12 are essentially locked to the rods 54 to ensure that the locks 12 will remain in their recesses 48 in the event that the lock box 10 is flipped upside down, dropped, or the like. Although other means of securing the locks 12 in their respective recesses 48 are foreseeable, it is believed that providing access to the lock securing means on an exterior of the lock box 10 will often be advantageous.

Preferably, the lock box 10 includes means for storing keys 14 of locks 12 that have been removed from the lock box 10 in a manner that is readily visible through the window 36. This may reduce the likelihood of the keys 14 becoming lost and promote ease of auditing. As a nonlimiting example, the lock box 10 may include one or more key holders secured within the interior cavity. As shown in the drawings, the lock box 10 can be equipped with a safety pin-type key holder 62 fixed to the rear wall 22 of the lock box 10 within the interior cavity. The key holder 62 may be opened to attach keys 14 thereto and then closed to secure the keys 14 thereon. Such structure advantageously allows the hanging keys 14 to be viewed through the window 36.

The lock box 10 may include other structural features conventional in the art, including for example, one or more handles 64 for ease of handling.

While the invention has been described in terms of a specific or particular embodiment, it is apparent that other forms could be adopted by one skilled in the art. For example, the physical configuration of the lock box 10 and its components could differ in appearance and construction from the embodiments described herein and shown in the drawings, and various materials could be used in the fabrication of the lock box 10 and/or its components. Accordingly, it should be understood that the invention is not necessarily limited to any embodiment described herein or shown in the drawings. It should also be understood that the phraseology and terminology employed above are for the purpose of describing the disclosed embodiments, and do not necessarily serve as limitations to the scope of the invention. Therefore, the scope of the invention is to be limited only by the following claims.

The invention claimed is:

1. A lock box for removably storing locks that have key holes and are operable with keys, the lock box comprising:

a container body having an exterior and an interior cavity defined by walls of the container body, at least a first of the walls comprising a window for viewing the interior cavity from the exterior of the container body;

means for protecting and concealing the window;

means within the interior cavity for arranging locks removably placed within the interior cavity so that the locks are arranged in an array and so that the key holes of the locks or any keys inserted therein are visible through the window and the locks can be visually audited; and means accessible from the exterior of the container body for securing the locks in the array within the interior cavity.

2. The lock box of claim 1, wherein the first wall is configured to be opened to provide access to the interior cavity and configured to be locked in a closed position to prevent access to the interior cavity.

3. The lock box of claim 2, wherein the first wall is pivotally coupled to a latch configured to mate with a hasp located on the exterior of the container body, wherein once mated the latch is secured by locking a shackle of a lock through the hasp thereby locking the first wall in the closed position.

4. The lock box of claim 1, wherein the means for protecting and concealing the window comprises a cover, and the first wall is configured to slidably receive the cover to entirely conceal the window.

5. The lock box of claim 4, further comprising means for releasably securing the cover over the window.

6. The lock box of claim 1, wherein the arranging means comprises a lock organization support plate fixed to the container body within the interior cavity and comprising an array of recesses each configured to receive a corresponding one of the locks.

7. The lock box of claim 6, wherein the recesses are configured to receive the locks shackle-first such that the key holes of the locks face and are visible through the window and the locks can be visually audited.

8. The lock box of claim 1, wherein the means for securing the locks in the array comprises a lock securement bracket including multiple elongated members configured to be inserted through corresponding holes in the exterior of the container body such that the elongated members pass through openings of shackles of the locks.

9. The lock box of claim 8, wherein the lock securement bracket includes a slot configured to mate with a hasp located on the exterior of the container body, wherein once mated the lock securement bracket is secured by locking a shackle of a lock through the hasp thereby locking the locks in fixed positions within the interior cavity.

10. The lock box of claim 9, wherein the first wall is configured to be opened to provide access to the interior cavity and configured to be locked in a closed position to prevent access to the interior cavity, the first wall pivotally coupled to a latch configured to mate with the hasp located on the exterior of the container body, wherein the slot and the latch are configured to mate with the hasp simultaneously, and wherein once both are mated with the hasp, the hasp is configured to receive a shackle of a lock therethrough thereby locking the first wall in the closed position and the lock securement bracket in a fixed position.

11. The lock box of claim 8, wherein the arranging means comprises a lock organization support plate fixed to the container body within the interior cavity and comprising an array of recesses each configured to receive a corresponding one of the locks shackle-first such that the key holes of the locks face and are visible through the window and the locks can be visually audited.

12. The lock box of claim 1, further comprising means within the interior cavity for securing keys removed from one or more of the locks that have been removed from the interior cavity so that the removed keys are visible through the window and can be visually audited.

13. The lock box of claim 12, wherein the means for securing the keys comprises a key holder fixed to the container body within the interior cavity and configured to releasably secure the keys removed from one or more of the locks that have been removed from the interior cavity in a hanging position visible through the window so that the keys can be visually audited.

14. A method of securing locks that have key holes and are operable with keys so that all of the locks and the keys thereof can be visually audited, the method comprising:

providing a lock box comprising a container body having an exterior and an interior cavity defined by walls of the container body, the walls comprising access means for providing access to the interior cavity of the container body and a window for viewing the interior cavity from the exterior of the container body without accessing the interior cavity of the container body;

removably placing locks within the interior cavity so that the locks are arranged in an array and so that all of the key holes of all of the locks within the interior cavity and any keys inserted therein are simultaneously visible through the window, and all of the locks within the interior cavity can be observed and counted through the window to confirm that the keys thereof are within the locks without accessing the interior cavity of the container body through the access means;

securing the locks in the array within the interior cavity;

locking the container body; and visually auditing all of the locks and the keys thereof within the interior cavity through the window by observing, counting, and confirming that all of the locks have the keys thereof within the locks without accessing the interior cavity of the container body through the access means and while the container body remains locked.

15. The method of claim 14, further comprising removing one or more of the locks from the interior cavity, removing the keys from the one or more locks, and securing within the interior cavity the keys removed from the one or more locks so that all of the keys secured within the interior cavity are simultaneously visible through the window and can be visually audited.

16. The method of claim 14, wherein one of the walls is a lid of the container body, the lid is the access means, and the method further comprises accessing the interior cavity of the container body by opening the lid.

17. The method of claim 16, wherein the window is in the lid and the auditing of all of the locks and the keys thereof is performed without opening the lid and while the container body remains locked.

18. The method of claim 14, further comprising protecting and concealing the window with a cover that is slidably received in one of the walls to entirely conceal and protect the window.

19. The method of claim 14, wherein the securing of the locks in the array within the interior cavity is performed with means accessible from the exterior of the container body.

20. The method of claim 14, wherein the removably placing of the locks within the interior cavity comprises individually placing each of the locks shackle-first in a corresponding recess of a plurality of recesses within the interior cavity, and the securing of the locks in the array comprises inserting elongated members through holes in the exterior of the container body such that the elongated members pass through openings of shackles of the locks.

* * * * *